US007699413B2

(12) United States Patent
Liao

(10) Patent No.: US 7,699,413 B2
(45) Date of Patent: Apr. 20, 2010

(54) TOOL CABINET

(76) Inventor: Hui-Chen Liao, No. 14, Lane 155, Sec. 3, Hsi-Tun Rd., Taichung (TW)

( * ) Notice: Subject to any disclaimer, the term of this patent is extended or adjusted under 35 U.S.C. 154(b) by 466 days.

(21) Appl. No.: 11/227,220

(22) Filed: Sep. 16, 2005

(65) Prior Publication Data

US 2007/0063624 A1 Mar. 22, 2007

(51) Int. Cl.
*A47B 77/10* (2006.01)

(52) U.S. Cl. ..... 312/282; 312/302; 312/312; 312/215

(58) Field of Classification Search ..... 312/196, 312/312, 319.1, 321, 281, 333, 301, 302, 312/205, 265.1, 283, 290; 211/94.01; 206/372, 206/373; 108/147.11
See application file for complete search history.

(56) References Cited

U.S. PATENT DOCUMENTS 2,057,544 A * 10/1936 Stratton ..... 312/297
3,297,387 A * 1/1967 Parsons ..... 312/290
3,954,182 A * 5/1976 McEvers ..... 211/94.01
4,585,127 A * 4/1986 Benedict ..... 211/34
4,641,837 A * 2/1987 Ruth ..... 482/104
4,944,656 A * 7/1990 Feng et al. ..... 116/173
5,031,782 A * 7/1991 Minervini ..... 211/46
5,497,878 A * 3/1996 Sandonato ..... 206/372
6,042,080 A * 3/2000 Shepherd et al. ..... 248/683
6,447,430 B1 * 9/2002 Webb et al. ..... 482/98
6,468,188 B1 * 10/2002 Koenig ..... 482/97
2007/0013280 A1 * 1/2007 Retchloff ..... 312/319.8

* cited by examiner

*Primary Examiner*—Janet M Wilkens
*Assistant Examiner*—Matthew W Ing
(74) *Attorney, Agent, or Firm*—Lowe Hauptman Ham & Berner, LLP

(57) ABSTRACT

A tool cabinet has a housing and a hanging device. The housing has a work surface, at least one drawer and at least one opening. The at least one drawer is defined in the housing. The hanging device has at least one hanger mounted inside the at least one opening. The at least one hanger has two telescopic stands, a hanging plate and a locking device. The telescopic stands are mounted in the at least one opening and face each other. The hanging plate is mounted between the telescopic stands and extends as the telescopic stands extend. The locking device mounted on the telescopic tubes to hold the inner tube in position. When the tool cabinet is used, the hanging device can be extended out to hang and store tools. The tools can be organized and the work surface will not in be cluttered.

5 Claims, 7 Drawing Sheets

TOOL CABINET

BACKGROUND OF THE INVENTION

1. Field of Invention

The present invention relates to a tool cabinet, and more particularly to a tool cabinet with a device for hanging tools.

2. Description of the Related Art

A conventional tool cabinet is used for storing tools and has many drawers for that propose. A conventional tool cabinet has a top surface that can serve as a work surface. However, it can become difficult to work on the limited area of the top surface as tools begin to clutter the work area. The tools stored in the drawers can be taken out to be used and then returned, but this can cause inconvenience.

Thus, a real need exists for a tool cabinet that is convenient to use as a work surface and for storage.

SUMMARY OF THE INVENTION

The primary objective of the present invention is to provide a tool cabinet that is convenient to use as a work surface and for storage.

A tool cabinet in accordance with the present invention has a housing and a hanging device. The housing has a work surface, at least one drawer and at least one opening. The at least one drawer is defined in the housing. The hanging device has at least one hanger mounted inside the at least one opening. The at least one hanger has two telescopic stands, a hanging plate and a locking device. The telescopic stands are mounted in the at least one opening and face each other. The hanging plate is mounted between the telescopic stands, and extends as the telescopic stands extend. The locking device is mounted on the telescopic stands to hold the stand in position when extended.

When the tool cabinet is used, the hanging device can be extended to hang and store tools. Then the tool clutter on the work surface will be mitigated.

Other objectives, advantages and novel features of the invention will become more apparent from the following detailed description when taken in conjunction with the accompanying drawings.

DETAILED DESCRIPTION OF THE INVENTION

Figure 1:
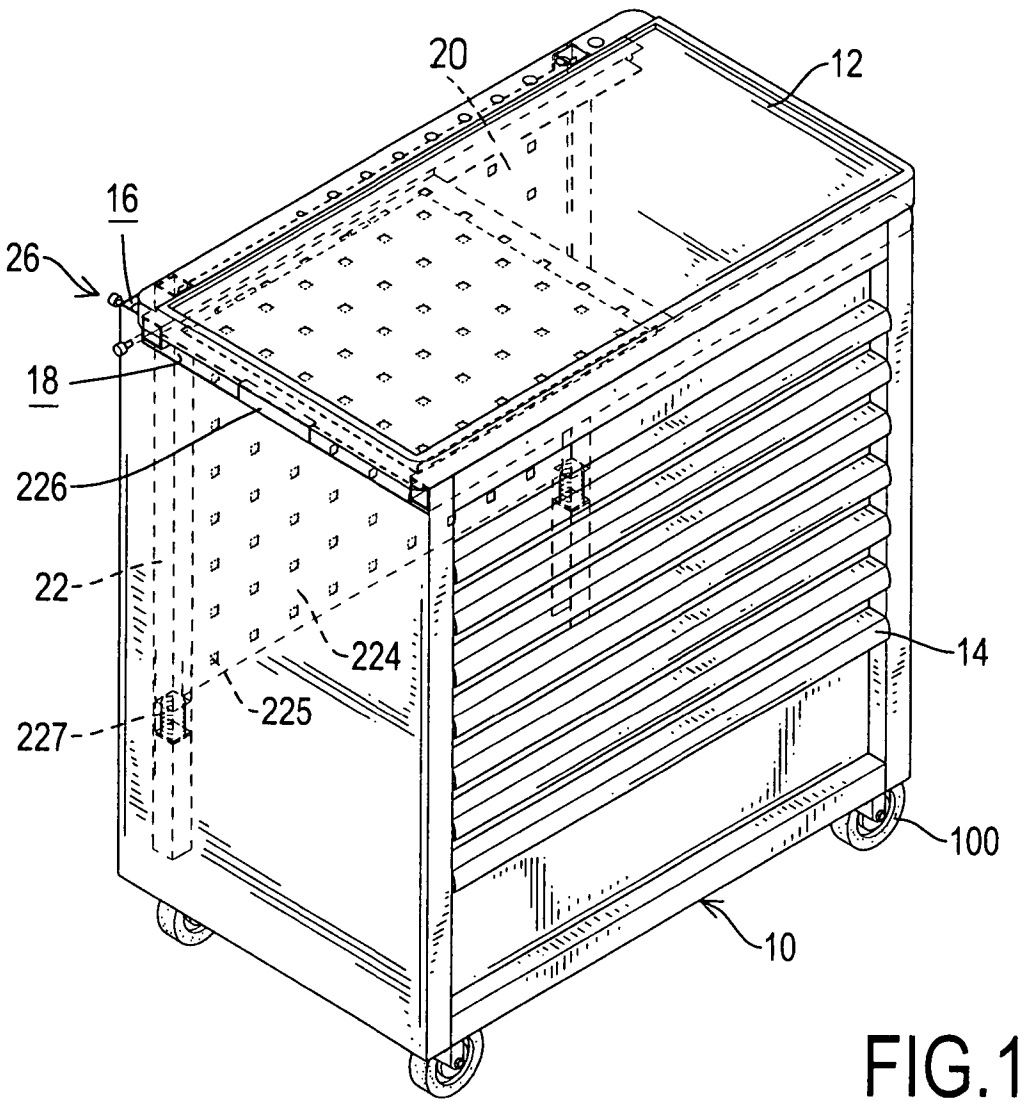
FIG. 1 is a perspective view of a first embodiment of a tool cabinet in accordance with the present invention.
Figure 2:
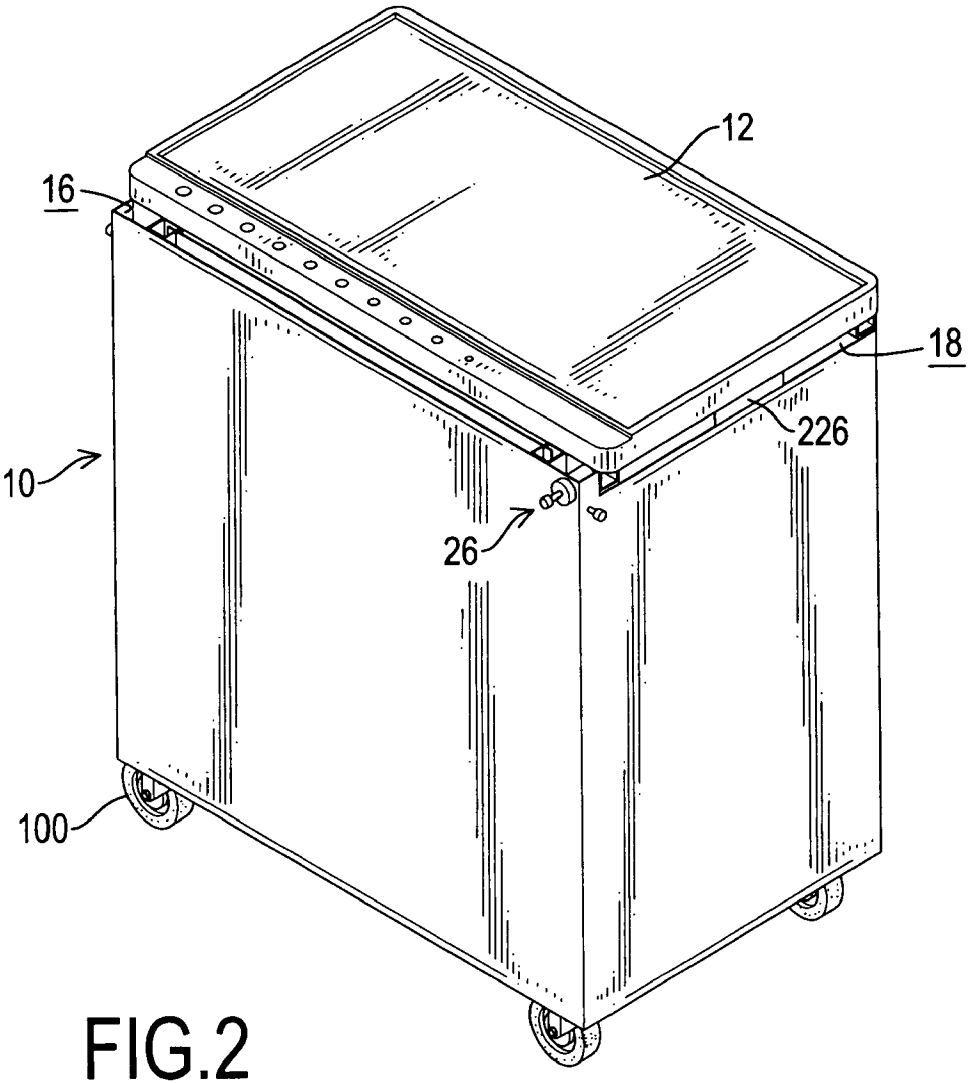
FIG. 2 is a rear perspective view of the tool cabinet in FIG. 1.
Figure 3:
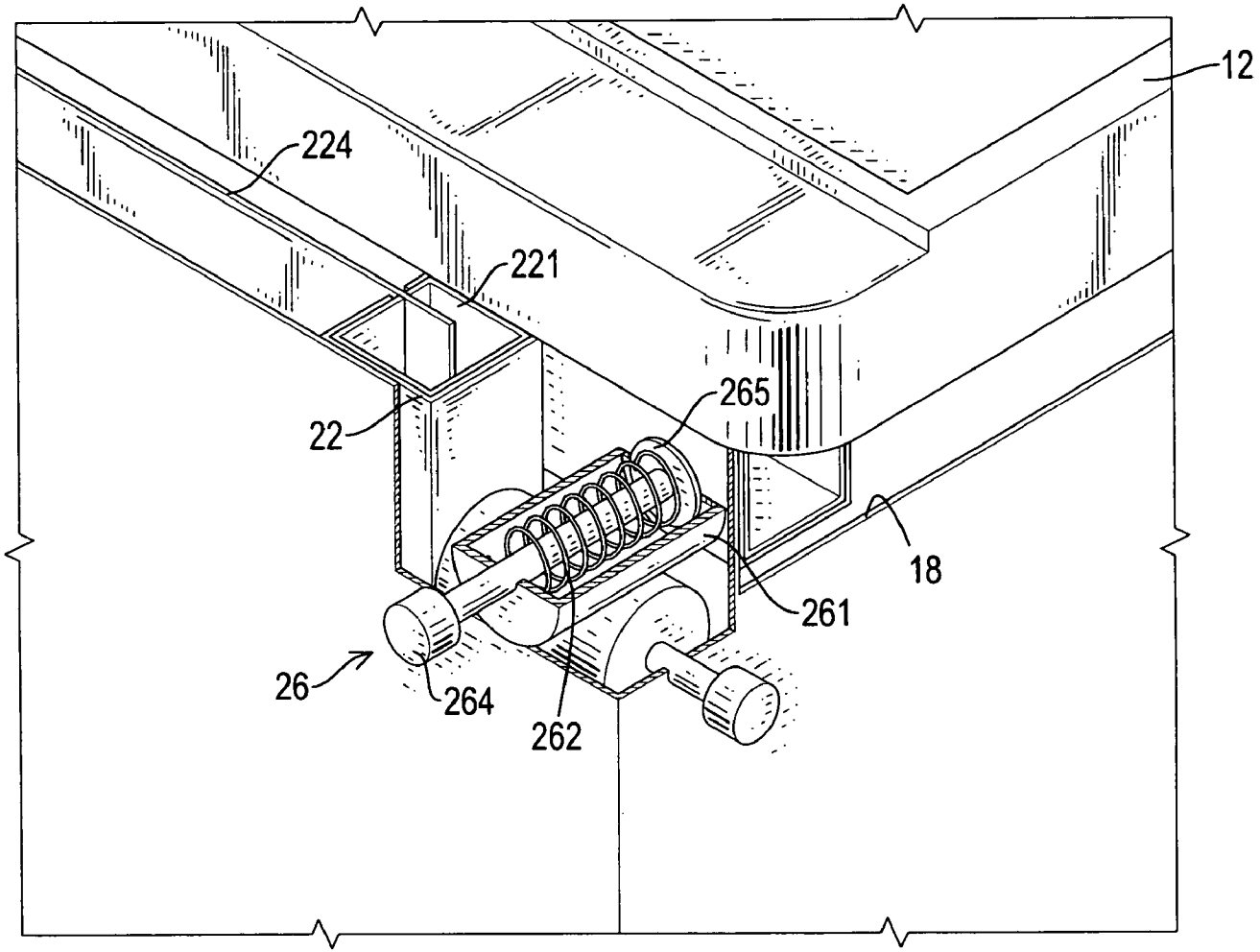
FIG. 3 is an enlarged perspective view in partial section of the tool cabinet in FIG. 1.

With reference to FIGS. 1 to 3 and 7, a tool cabinet in accordance with the present invention has a housing (10) and a hanging device (20).

The housing (10) has a top surface, a front surface, a rear surface, two side surfaces, a work surface (12), at least one drawer (14), at least one opening and multiple wheels (100). The work surface (12) is mounted on the top surface. The at least one drawer (14) is mounted inside the housing (100) and can be drawn out from the front surface of the housing (10). The at least one opening is defined in the housing (100). In a preferred embodiment, there are at least two openings; one is a vertical opening (16) and the other one is a horizontal opening (18). The vertical opening (16) is defined in the top surface inside the rear surface. The horizontal opening (18) is defined in a side surface of the housing (10) and under the work surface (12). The wheels (100) are mounted under the housing (10) for movement.

Figure 6:
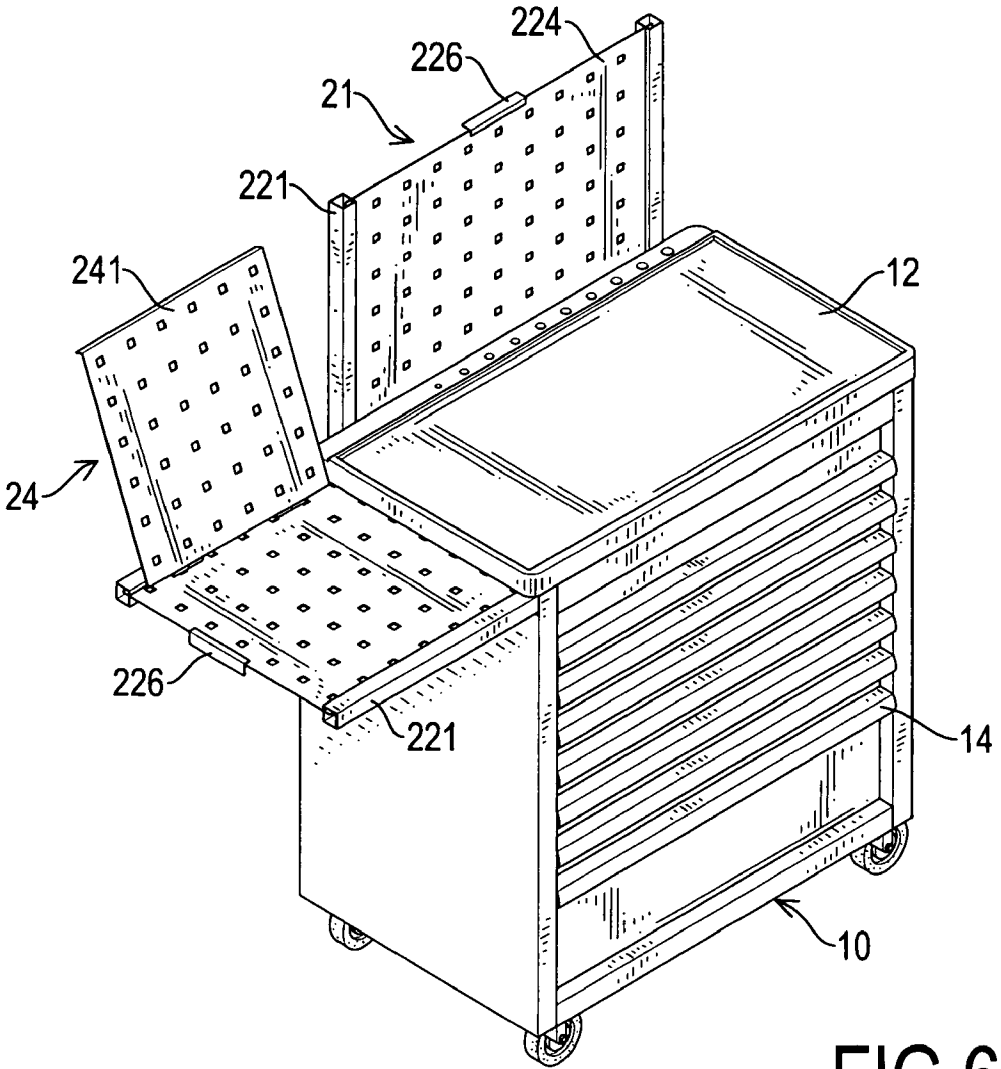
FIG. 6 is a perspective view of the tool cabinet in FIG. 1 with a hanging device extended.

With further reference to FIG. 6, the hanging device (20) has at least one hanger (21, 24). In a preferred embodiment, the hanging device (20) has a vertical hanger (21) and a horizontal hanger (24). The vertical hanger (21) is mounted inside the vertical opening (16) in the housing (10). The horizontal hanger (24) is mounted inside the horizontal opening (18) in the housing (10). The elements of the vertical hanger (21) and the horizontal hanger (24) are almost the same and only differ at the mounting orientation of the two hangers (21, 24). The following description will only describe the vertical hanger (21) in detail.

Figure 4:
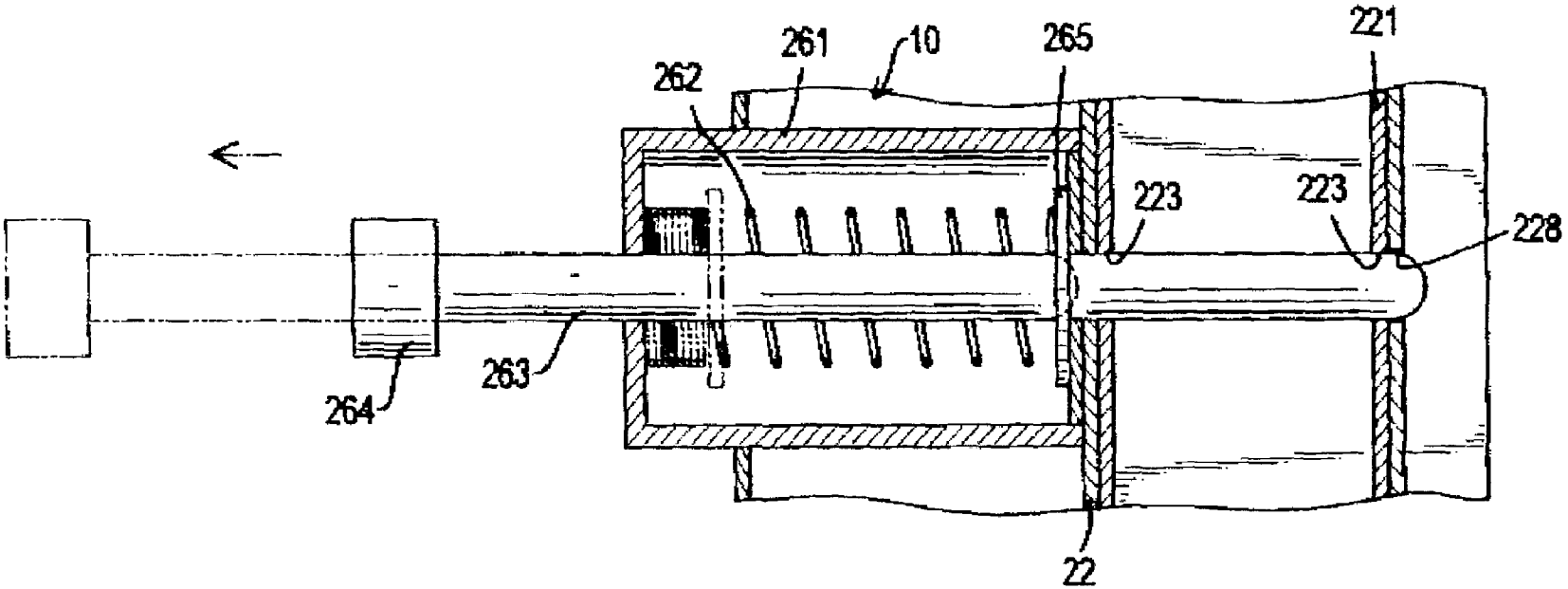
FIG. 4 is an enlarged sectional side view of a locking device of the tool cabinet in FIG. 1.

With further reference to FIGS. 4 and 6, the vertical hanger (21) has two telescopic stands, a hanging plate (224), a buffering device (227) and a locking device (26). The telescopic stands are mounted in the vertical opening (16) and face each other. Each telescopic stand has an outer tube (22), an inner tube (221) and a sliding groove (222). The outer tube (22) has an inner end and an outer end. The inner tube (221) is mounted inside the outer tube (22) and has an inner end, an outer end and multiple positioning holes (223). The positioning holes (223) are defined diametrically through two sides of and at the outer end of the inner tube (221) along its length. The sliding groove (222) is defined along the length of each telescopic stand, through both the outer tube (22) and the inner tube (221), and face each other. The outer tube (22) further has a positioning hole defined diametrically through two sides of the outer tube (22) and aligns with one of the positioning holes in the inner tube (221). The hanging plate (224) is mounted in the sliding grooves (222) between the telescopic stands and has a handle (226) and multiple holes (225) for hanging. The handle (226) is mounted on the hanging plate (224) at the vertical opening (16). The buffering device (227) is mounted inside the outer tube (22) near the inner end.

With reference to FIG. 4, the locking device (26) is mounted on the outer end of the outer tube (22) to hold the inner tube (221) in position when extended. The locking device (26) has a body (261), a resilient spring (262), a rod (263), a head (264) and a plate (265). The body (261) is mounted at the outer end of the outer tube (22) and has an inner cavity. The rod (263) is mounted through the body (261) and has an inner end and an outer end. The inner end of the rod (263) can extend from the body (261) to hold the telescopic stand in position when extended. The resilient spring (262) is mounted on the rod. (263) and has two ends. The head (264) is mounted on the outer end of the rod (263). The plate (265) is mounted around the rod (263) and abuts one end of the resilient spring (262). The resilient spring (262) forces the rod (263) to extend out of the body (261). When the rod (263) extends out of the body (261) and through the outer tube (22) and the inner tube (221 via the aligning positioning holes (223, 228) in the outer tube (22) and the inner tube (221), the plate (265) abuts the body (261).

With further reference to FIGS. 4 and 6, to use the hanging device (20), the hanging plate (224) is pulled out of the vertical opening (16) by the handle (226). The hanging device (20) is then locked into position by the rod (263) of the locking device (26). To store the hanging device (20), the head (264) on the rod (263) is pulled back, the rod (263) is drawn back inside the body (261) of the locking device (20), and the plate (265) abuts the resilient spring (262) to make resilient spring (262) contract. Then the hanging plate (224) can be retracted into the vertical opening (16) or adjusted to a suitable position for hanging tools.

In a preferred embodiment, the horizontal hanger (24) further comprises a pivotal plate (241) pivoted on the plate.

Figure 5:
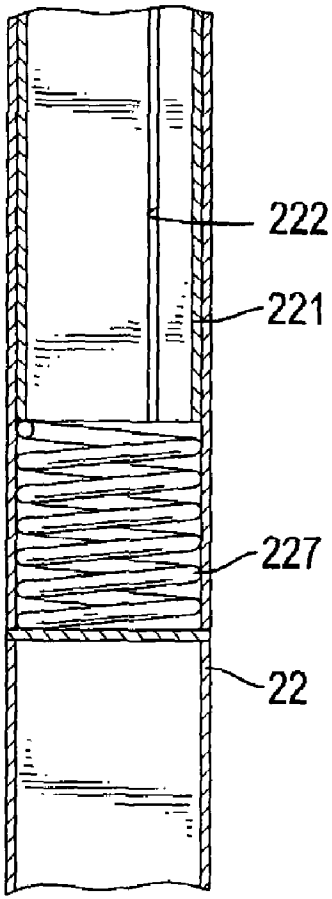
FIG. 5 is an enlarged sectional side view of a buffer device of the tool cabinet in FIG. 1.

With reference to FIG. 5, the weight of the hanging plate (224) is supported by the buffering device (227).

Figure 7:
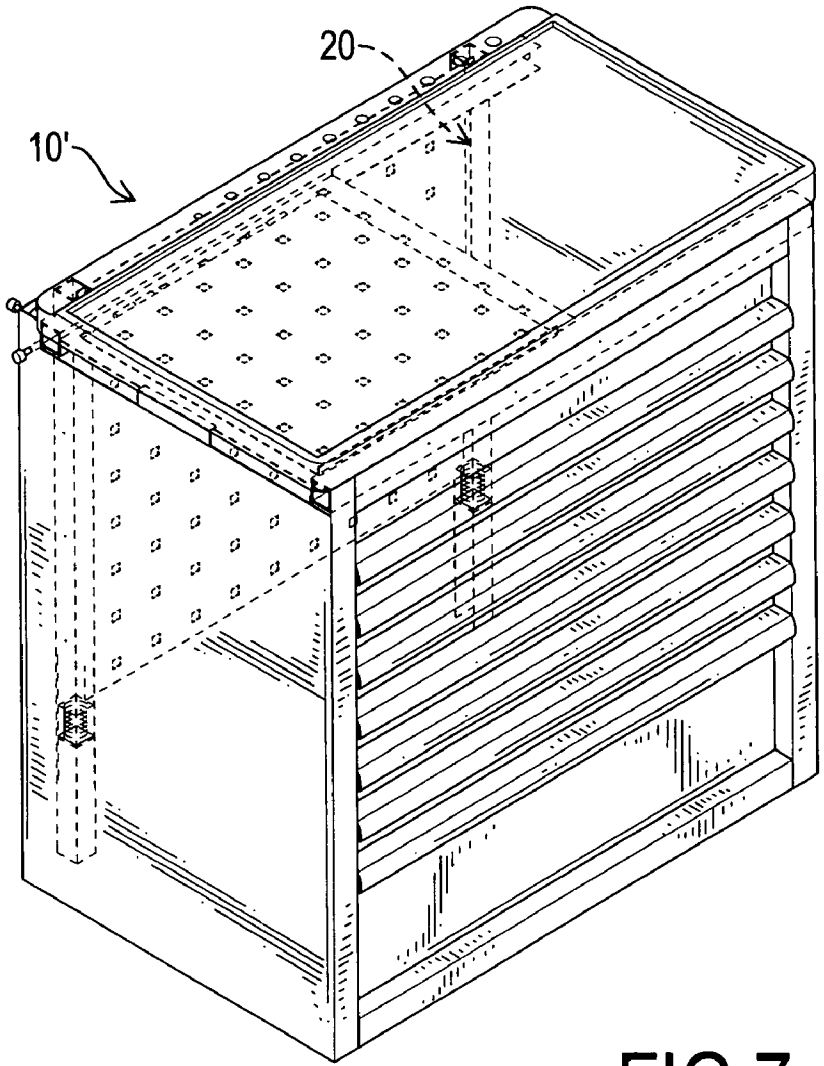
FIG. 7 is a perspective view of a second embodiment of a tool cabinet in accordance with the present invention.

With reference to FIG. 7, a second embodiment of the tool cabinet (10') has almost the same elements as the first embodiment, but without wheels.

The advantages of a tool cabinet in accordance with the present invention are as follows.

1. The hanging device (20) mounted inside the housing (100) provides more area for storing tools, and allows the tools to be organized.

2. The hanging device (20) is mounted inside the housing (100), and can be easily stored when not in use.

3. The elements of the hanging device (20) of the present invention are simple and the hanging device (20) is convenient to use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool cabinet comprising a housing having
a top surface,
a front surface,
a rear surface,
two side surfaces,
a work surface mounted on the top surface,
at least one drawer mounted inside the housing at the front surface,
a vertical opening defined in the housing and being parallel with the rear surface, and
a horizontal opening defined in the housing and, being parallel with the top surface and perpendicular to the vertical opening, and
a hanging device having
two hangers including a vertical hanger and a horizontal hanger, mounted respectively inside the vertical and horizontal openings and each having
two telescopic stands mounted in a corresponding one of the openings and facing each other, each telescopic stand having
an outer tube having
an inner end,
an outer end,
a positioning hole defined through two sides of the outer tube, and
a buffering device mounted inside the outer tube near the inner end to support the hanging plate,
an inner tube mounted inside the outer tube and having
an inner end,
an outer end, and
multiple set of positioning holes defined diametrically through two sides of the inner tube, wherein one set of the positioning holes in the inner tube aligns with the positioning hole in the outer tube, and
a sliding slit defined along the telescopic stand through the outer tube and the inner tube and facing each other,
a hanging plate mounted in the sliding slits between the telescopic stands and having
a handle mounted on the hanging plate at the corresponding opening,
multiple holes defined in the hanging plate for hanging, and
a locking device mounted on the outer end of the outer tube of one of the telescopic stands to hold the inner tube in position and comprising
a body mounted at the outer end of the outer tube and having an inner cavity,
a rod mounted through the body and having
an inner end, extending through the outer tube and the inner tube via the positioning holes that align with each other in the outer tube and the inner tube, and
an outer end,
a resilient spring mounted on the rod and having two ends,
a head mounted on the outer end of the rod, and
a plate mounted around the rod and abutting one end of the resilient spring.

2. The tool cabinet as claimed in claim 1, wherein the horizontal hanger further comprises a plate pivotally mounted on the hanging plate.

3. The tool cabinet as claimed in claim 2, wherein each buffering device is a spring.

4. The tool cabinet as claimed in claim 3, wherein each hanging plate of the hanging device further comprises a handle mounted at the corresponding opening.

5. The tool cabinet as claimed in claim 4, wherein the housing further comprises multiple wheels mounted on the housing.

* * * * *